US006341597B1

(12) United States Patent
Cohen

(10) Patent No.: US 6,341,597 B1
(45) Date of Patent: Jan. 29, 2002

(54) FUEL INJECTION SYSTEM FOR HIGH VAPOR PRESSURE LIQUID FUEL

(75) Inventor: James H. Cohen, Virginia Beach, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/370,849

(22) Filed: Aug. 10, 1999

Related U.S. Application Data

(60) Provisional application No. 60/106,765, filed on Nov. 3, 1998.

(51) Int. Cl.[7] ..... F02M 37/04
(52) U.S. Cl. ..... 123/516; 123/470
(58) Field of Search ..... 123/516, 470, 123/469, 468, 518, 514, 472

(56) References Cited

U.S. PATENT DOCUMENTS

| | | | | |
|---|---|---|---|---|
| 4,186,708 A | | 2/1980 | Bowler | 123/139 |
| 4,230,273 A | | 10/1980 | Claxton et al. | 239/125 |
| 4,235,375 A | | 11/1980 | Melotti | 239/125 |
| 4,341,193 A | | 7/1982 | Bowler | 123/472 |
| 4,416,238 A | | 11/1983 | Knapp et al. | 123/470 |
| 4,589,381 A | | 5/1986 | Takayama | 123/52 |
| 4,601,275 A | * | 7/1986 | Weinand | 123/468 |
| 4,725,041 A | | 2/1988 | Chauvin et al. | 251/129.15 |
| 4,747,384 A | | 5/1988 | Hafner et al. | 123/470 |
| 4,844,036 A | | 7/1989 | Bassler et al. | 123/470 |
| 5,012,787 A | | 5/1991 | Hafner et al. | 123/470 |
| 5,080,070 A | | 1/1992 | Hafner | 123/470 |

OTHER PUBLICATIONS

Patent Abstracts of Japan—vol. 009, No. 202 (M–405), Aug. 20, 1985 (1985–08–20) & JP 60 065267 A (Hitachi Seisakusho KK), Apr. 15, 1985 (1985–04–15) abstract.

* cited by examiner

*Primary Examiner*—Carl S. Miller

(57) ABSTRACT

A fuel injection system includes at least two fuel injectors; each fuel injector including at least one fuel inlet and at least one vapor outlet, the at least one vapor outlet being located vertically higher than the at least one fuel inlet; at least two pods, one fuel injector being inserted in each pod, respectively; each pod including a fuel inlet connection in fluid communication with the at least one fuel inlet of the injector and a fuel return connection in fluid communication with the at least one vapor outlet of the injector, the fuel return connection being located vertically higher than the fuel inlet connection; and a fuel supply line connected to the fuel inlet connection of each of the pods and a fuel return line connected to the fuel return connection of each of the pods such that the pods with the injectors inserted therein are connected in a parallel arrangement.

9 Claims, 2 Drawing Sheets

FUEL INJECTION SYSTEM FOR HIGH VAPOR PRESSURE LIQUID FUEL

RELATED APPLICATIONS

This application claims the benefit of priority of provisional patent application Ser. No. 60/106,765 filed Nov. 3, 1998.

BACKGROUND OF THE INVENTION

The invention relates in general to fuel injection systems and in particular to fuel injection systems for handling high vapor pressure liquid fuel.

A problem with high pressure fuel injection systems is supplying each fuel injection valve with enough liquid fuel to insure reliable engine starting. One aspect of the problem is the presence of vapor bubbles in the injectors. The vapor bubbles must be flushed out and replaced with liquid fuel for reliable engine starting. The problem is more severe in a hot-start condition wherein fuel is present in vapor form in the fuel lines and in the individual fuel injection valves. The vapor bubbles must be rapidly flushed out from the injectors and the injectors cooled down.

SUMMARY OF THE INVENTION

The present invention provides a fuel injection system comprising at least two fuel injectors; each fuel injector including at least one fuel inlet and at least one vapor outlet, the at least one vapor outlet being located vertically higher than the at least one fuel inlet; at least two pods, one fuel injector being inserted in each pod, respectively; each pod including a fuel inlet connection in fluid communication with the at least one fuel inlet of the injector and a fuel return connection in fluid communication with the at least one vapor outlet of the injector, the fuel return connection being located vertically higher than the fuel inlet connection; a fuel supply line connected to the fuel inlet connection of each of the pods and a fuel return line connected to the fuel return connection of each of the pods such that the pods with the injectors inserted therein are connected in a parallel arrangement.

In the fuel injection system, each of the at least two injectors includes internal passageways fluidly communicating the at least one fuel inlet of the injector with the at least one vapor outlet of the injector. Preferably, an internal surface of each pod and an external surface of an injector inserted in the pod define a fluid passageway between the fuel inlet connection of the pod and the fuel return connection of the pod wherein the fluid passageway is external to the injector.

Further objects, features and advantages of the invention will become apparent from the following detailed description taken in conjunction with the following drawing.

DETAILED DESCRIPTION OF THE PREFERRED EMBODIMENTS

A fuel injection system according to the present invention insures rapid thorough flushing of the fuel injection valves and rapid cooling down of the fuel injection valves. Even under hot start conditions the necessary supply of fuel to the engine is assured and the engine starts and keeps running without interruptions, by means of rapid flushing of any fuel vapor that may be present out of the fuel injection valves and away from the injector valve seat.

A fuel injection system in accordance with the present invention includes a fuel injector pod that accommodates a fuel injector. The fuel injector may meter gasoline, liquid petroleum gas, or other high vapor pressure liquid petroleum and non-petroleum fuels. The fuel pod is connectable via a fuel rail to other pods to supply more than one cylinder of an engine. The pod efficiently purges vaporized fuel from liquid fuel. The efficient purging of the vaporized fuel maintains liquid fuel at the injector metering orifice, which provides stable and predictable metering of the fuel.

The pod improves hot engine restart by enabling fuel vapor bubbles to rise away from the fuel inlet and fuel metering components of a fuel injector. The rising fuel vapor bubbles escape the pod through a fuel return line located at a higher elevation than the fuel inlet. Liquid, being heavier than vapor, remains in the bottom of the pod near the fuel metering components due to gravity.

Fuel flows from the pod, which is external to the injector, to the interior of the injector through openings in the injector housing. The fuel flows internally through the injector to the metering orifice via passageways in the injector. Fuel also flows from the interior of the injector back to the pod via fuel purge vents in the injector housing.

A fuel rail having two passages is used with the pods. The lower passage is a fuel inlet passage that supplies liquid fuel to the lower part of the pod. The upper passage is a fuel vapor vent/fuel return passage that conducts vapor and excess fuel back to the fuel tank.

Fuel is supplied to each pod in parallel. That is, each pod is fed independently of each other pod so that the flow of fuel to a single pod does not restrict the flow of fuel to any other pod. In contrast to pods mounted in series at the end of a fuel feed line, the upstream pods do not starve the downstream pods in a parallel arrangement. The parallel arrangement helps to optimize vapor purging and minimize heat input to the fuel.

Figure 1:
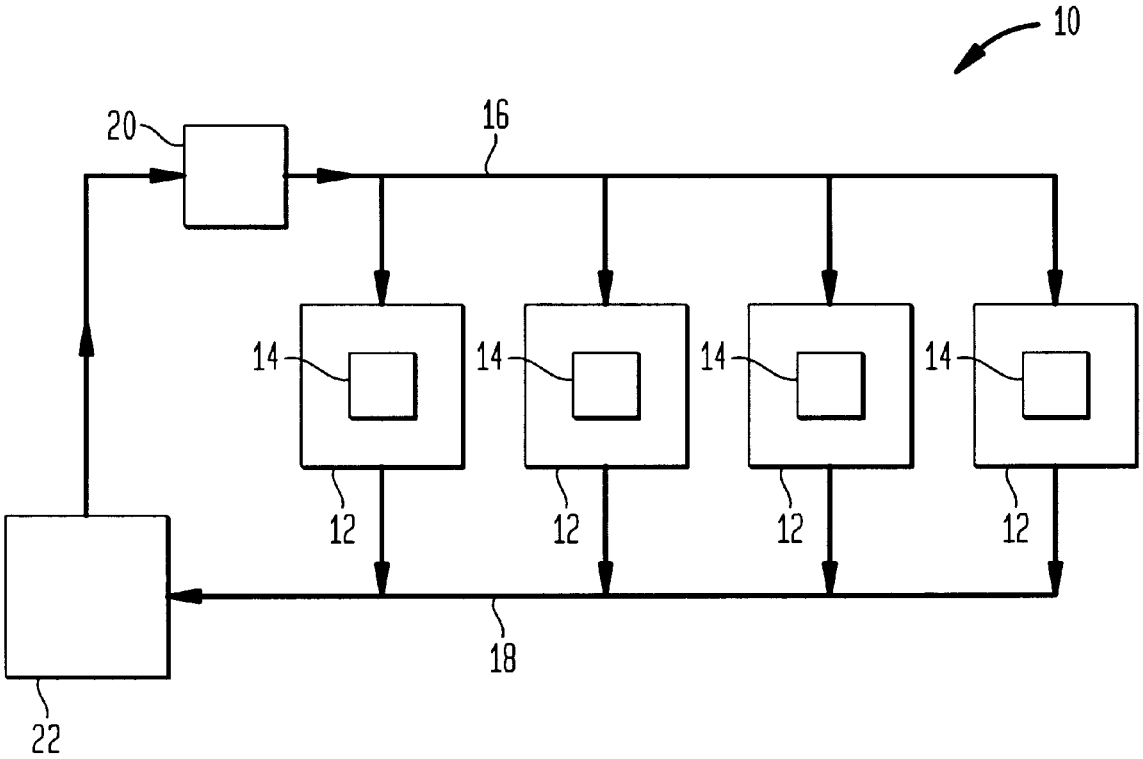
FIG. 1 schematically shows a top view of one embodiment of the fuel injection system according to the present invention.

FIG. 1 schematically shows a top view of one embodiment of a fuel injection system 10 according to the present invention. The system 10 includes a plurality of pods 12 having bottom feed fuel injectors 14 inserted therein. A fuel pump 20 pumps fuel from a fuel tank 22 through a fuel supply line 16 to each pod 12. Fuel vapor and liquid fuel return to the fuel tank 22 via a fuel return line 18. The fuel supply line 16, fuel return line 18 and pods 12 are connected in a parallel arrangement. The pods 12 are mounted on the intake air manifold (not shown). The pods are made of a material having low thermal conductivity. The pods 12 may be made of, for example, glass-filled nylon, plastic or a metal with low thermal conductivity. The pods 12 are usually formed by molding, but may be machined.

FIG. 1 shows four pods, however, the number of pods 12 may be any number greater than or equal to two. Each pod 12 with injector 14 inserted therein provides fuel to one cylinder (not shown) of an internal combustion engine. The fuel supply line 16 is located at a lower elevation than the fuel return line 18. The difference in elevation causes the fuel vapor to rise to the fuel return line 18. In FIG. 1, the supply line 16 and return line 18 are shown on opposite sides of the pods 12. However, the supply and return lines 16, 18 can both be located on the same side of the pods 12 as long as the supply line 16 is at a lower elevation than the return line 18 and the lines are connected to the pods in a parallel arrangement.

Figure 2:
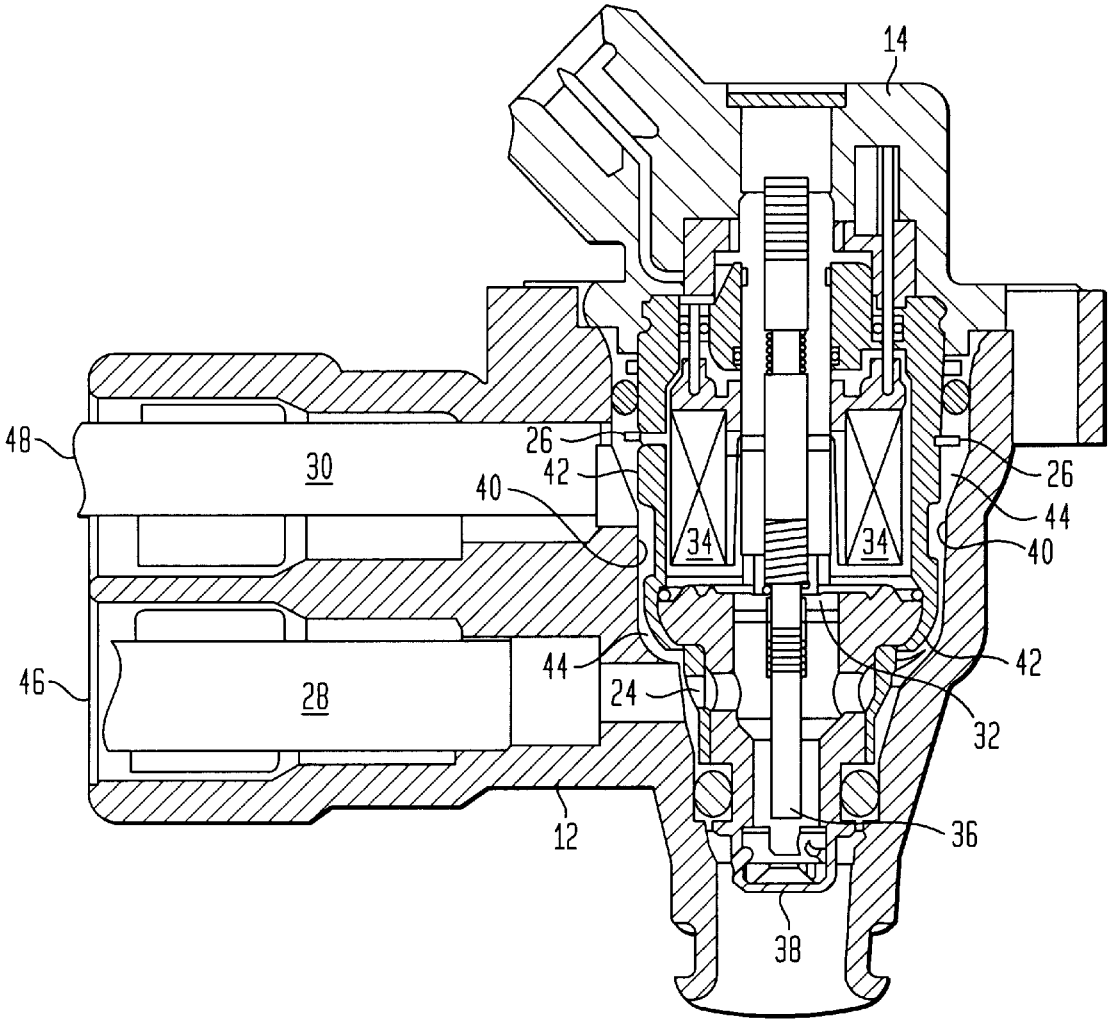
FIG. 2 is a cross-sectional side view of one embodiment of a fuel injector and pod according to the present invention.

FIG. 2 is a cross-sectional side view of one embodiment of a fuel injector 14 and pod 12 according to the present invention. The fuel injector 14 is inserted in an opening in the pod 12. The pod 12 includes a fuel inlet connection 28 and a fuel return connection 30. The fuel inlet connection 28 is lower in elevation than the fuel return connection 30. One end 46 of the fuel inlet connection 28 is connected to the fuel supply line 16. One end 48 of the fuel return connection 30 is connected to the fuel return line 18.

The injector 14 includes at least one fuel inlet 24 and at least one vapor outlet 26. The fuel inlet 24 is lower in elevation than the vapor outlet 26. In a preferred embodiment, there are four fuel inlets 24 and two vapor outlets 26 arranged circumferentially around the injector 14. Fuel is supplied to the injector 14 from the pod inlet connection 28 to the injector fuel inlet 24. Fuel that is consumed by the engine passes by the needle valve 36 and out the injector tip 38. Unused liquid fuel and fuel vapor bubbles flow through internal passageways in the injector 14 to the vapor outlet 26. From the vapor outlet 26, the fuel flows to the pod fuel return connection 30 to the fuel return line 18 and back to the fuel tank 22.

One internal passageway that the unused fuel and fuel vapor bubbles may take is upwards past the needle valve 36 to the armature 32. The armature 32 contains openings through which the fuel may pass. The fuel then flows around the electric coils 34 to one or more vapor outlets 26.

In one embodiment, fuel may also flow from the pod fuel inlet connection 28 to the pod fuel return connection 30 via a passageway 44 that is external to the injector 14. The passageway 44 is defined by an internal surface 40 of the pod 12 and an external surface 42 of the injector 14. The external passageway 44 allows vapor bubbles to flow directly from the fuel inlet 28 to the vapor outlet 26. The external passageway 44 may extend circumferentially around the entire injector 14 thereby attaining a generally annular shape.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A fuel injection system comprising:

at least two fuel injectors; each fuel injector including at least one fuel inlet and at least one vapor outlet, the at least one vapor outlet being located vertically higher than the at least one fuel inlet;

at least two pods, one fuel injector being inserted in each pod, respectively; each pod including a fuel inlet connection in fluid communication with the at least one fuel inlet of the injector and a fuel return connection in fluid communication with the at least one vapor outlet of the injector, the fuel return connection being located vertically higher than the fuel inlet connection;

a fuel supply line connected to the fuel inlet connection of each of the pods and a fuel return line connected to the fuel return connection of each of the pods such that the pods with the injectors inserted therein are connected in a parallel arrangement.

2. The fuel injection system of claim 1 wherein each of the at least two injectors includes internal passageways fluidly communicating the at least one fuel inlet of the injector with the at least one vapor outlet of the injector.

3. The fuel injection system of claim 2 wherein an internal surface of each pod and an external surface of an injector inserted in the pod define a fluid passageway between the fuel inlet connection of the pod and the fuel return connection of the pod wherein the fluid passageway is external to the injector.

4. The fuel injection system of claim 1 further comprising a fuel pump connected to the fuel supply line.

5. The fuel injection system of claim 4 further comprising a fuel tank connected to the fuel return line.

6. The fuel injection system of claim 3 wherein the fluid passageway between the fuel inlet connection of the pod and the fuel return connection of the pod is generally annularly shaped.

7. The fuel injection system of claim 1 wherein the at least two fuel injectors are bottom feed fuel injectors.

8. The fuel injection system of claim 1 wherein a number of fuel inlets in each injector is four.

9. The fuel injection system of claim 1 wherein a number of vapor outlets in each injector is two.

* * * * *